US006050716A

United States Patent [19]

Hsu

[11] Patent Number: 6,050,716

[45] Date of Patent: Apr. 18, 2000

[54] LIGHTED INDICATOR ASSEMBLY WITH REMOVABLE FRAME BODY AND LIGHT PLATE

[76] Inventor: Chin Yung Hsu, 4F, No. 7, Lane 10, Sec. 3, Hsin Sheng S. Rd., Taipei, Taiwan

[21] Appl. No.: 09/022,483

[22] Filed: Feb. 12, 1998

[51] Int. Cl.[7] ..... G09F 13/26

[52] U.S. Cl. ..... 362/812; 362/217; 362/221; 362/225; 362/236; 362/238

[58] Field of Search ..... 362/217, 221–225, 362/249, 362, 812, 227, 236, 238, 260

[56] References Cited

U.S. PATENT DOCUMENTS

| | | | |
|---|---|---|---|
| 5,150,964 | 9/1992 | Tsui | 362/251 |
| 5,245,519 | 9/1993 | Openiano | 362/252 |
| 5,247,756 | 9/1993 | Johnstone | 40/570 |
| 5,267,404 | 12/1993 | Kizy | 40/545 |
| 5,267,807 | 12/1993 | Biedermann et al. | 403/375 |
| 5,295,050 | 3/1994 | Helstern et al. | 362/27 |
| 5,416,679 | 5/1995 | Ruskouski et al. | 362/240 |
| 5,421,556 | 6/1995 | Dodge et al. | 256/1 |
| 5,533,286 | 7/1996 | Fallon et al. | 40/545 |

*Primary Examiner*—Sandra O'Shea
*Assistant Examiner*—Ismael Negron
*Attorney, Agent, or Firm*—Rosenberg, Klein & Lee

[57] ABSTRACT

A lighting indicator assembly is provided that includes a main unit, a light plate and an outside frame. Inside the main unit a voltage transformer, circuits and other components are accommodated. The light plate includes a plate body, on which grooves are formed. The grooves outline alphanumeric characters. A plurality of light tubes are disposed in the grooves to form illuminated representations of the alphanumeric characters. At least two light tubes form each character. The light tubes are connected to each other by connecting wires and connectors. The light plate is accommodated at the front side of the main unit. The outside frame is fitted to the front of the main unit. The outside frame and main unit are joined as one unit by means of projections on the outside frame engaging openings formed in the main unit. The outside frame presses and fixes the plate body of the light plate to the main unit.

2 Claims, 7 Drawing Sheets

LIGHTED INDICATOR ASSEMBLY WITH REMOVABLE FRAME BODY AND LIGHT PLATE

BACKGROUND OF THE INVENTION

The subject matter relates to an assembly of lighting indicator, particularly to one with the features of more convenient replacement and reduced costs.

As illustrated in FIGS. 1 and 2, a prior art of lighting indicator comprises a main unit 1 and a light plate 2, in the main unit are accommodated a voltage transformer 3, circuits and other components, on the light plate 2 are grooves 4, said grooves 4 will make out the outlines of letter types, a continuous light tube 5 is embedded in the groove 4 and extending along the shape of the groove, said light tube 5 makes out the outline of letter types of the groove 4, the light tubes 5 are connected by welding process, the light tube 5 and the transformer 3 inside the main unit 1 are connected by a connecting wire 6, to the outside of the light plate 2 is fixed a frame unit 7, on the frame unit 7 is the formation of a through viewing window 8, when said lighting indicator is in application, an appropriate power source is supplied via the transformer 3, the connecting wire 6 to the light tube 5, to illuminate the light tube 5 inside the groove 4 on the light plate 2, thus the light tube 5 will project light rays to meet human eyes.

In the above mentioned prior art of lighting indicator, however, the light plate 2 and the frame body 7 are fixed together in inseparable connection, in case the letter types or figures on the light plate 2 need to be replaced, the entire frame body 7 has to be replaced altogether, thus it will increase the costs, and the main unit 1 and the light plate 2 are joined together by means of tightening screw 9, so it could not be disassembled conveniently, and a particular tool must be used for the disassembling process, furthermore, the flight tubes 5 are welded to each other, the non-letter-type portion of the light tube 5 has to be treated for light obstruction, or it has to pass by the rear of the light plate 2, which will lengthen the light tube and consume much more power energy, and in case the light tube 5 is defective, the light tube 5 could not be separately replaced, instead, the whole welded unit of the light tube 5 has to be removed and replaced, hence its increased costs and failure to meet economic efficiency.

SUMMARY OF THE INVENTION

The primary objective of the subject matter is to present an assembly of lighting indicators, which comprises a main unit, a light plate and an outside frame, inside the main unit is accommodated a voltage transformer and other circuit components, the front part of said main unit is the formation of a carrier part, the light plate includes a plate body, on said plate body are appropriate grooves, said grooves will make out the outline of letter types, the light tubes are embedded inside the grooves and extending along the shape of the groove, said light tubes make out the outline of letter types of the groove, the light tubes are connected to each other by connecting wires and connectors, said light plate is accommodated in the carrier part at the front of the main unit, the light tubes are connected to the transformer in the main unit by means of connecting wires and connectors, the outside frame includes a panel and a side plate, on the panel is the formation of a through viewing window, said outside frame is fitted to the front of the main unit, and by means of projections, the outside frame and the main unit are joined as one unit, while the panel of the outside frame serves to press and fix the plate body into the carrier part of the main unit, to comprise the lighting indicator; the main unit, light plate and outside frame of the subject matter can be separated, in case the letter types or figures on the light plate need to be changed, only the light plate need to be removed and replaced, there is no need to replace the outside frame, so it will reduce the costs, and the main unit, light plate and outside frame of the subject matter are joined as one unit by means of projections, so it is quite convenient to assemble or disassemble them without the use of any tools, furthermore, between the light tubes, and between the light tubes and the transformer is the connection by connecting wires and connectors, so that the light tubes can be connected to each other without the need of a welding process, so that they can save power consumption, and in case of a defective light tube, the defective light tube can be removed and replaced separately, so there is no need to remove and replace the entire set of light tubes, thus there is the feature of reduced costs.

To enable full understanding of the characteristics and technical contents of the subject matter please refer to the following detailed description with drawings; however, the attached drawings are only for the purposes of reference and description, which shall not be based to restrict or limit the subject matter:

DETAILED DESCRIPTION OF PREFERRED EMBODIMENT

Figure 1:
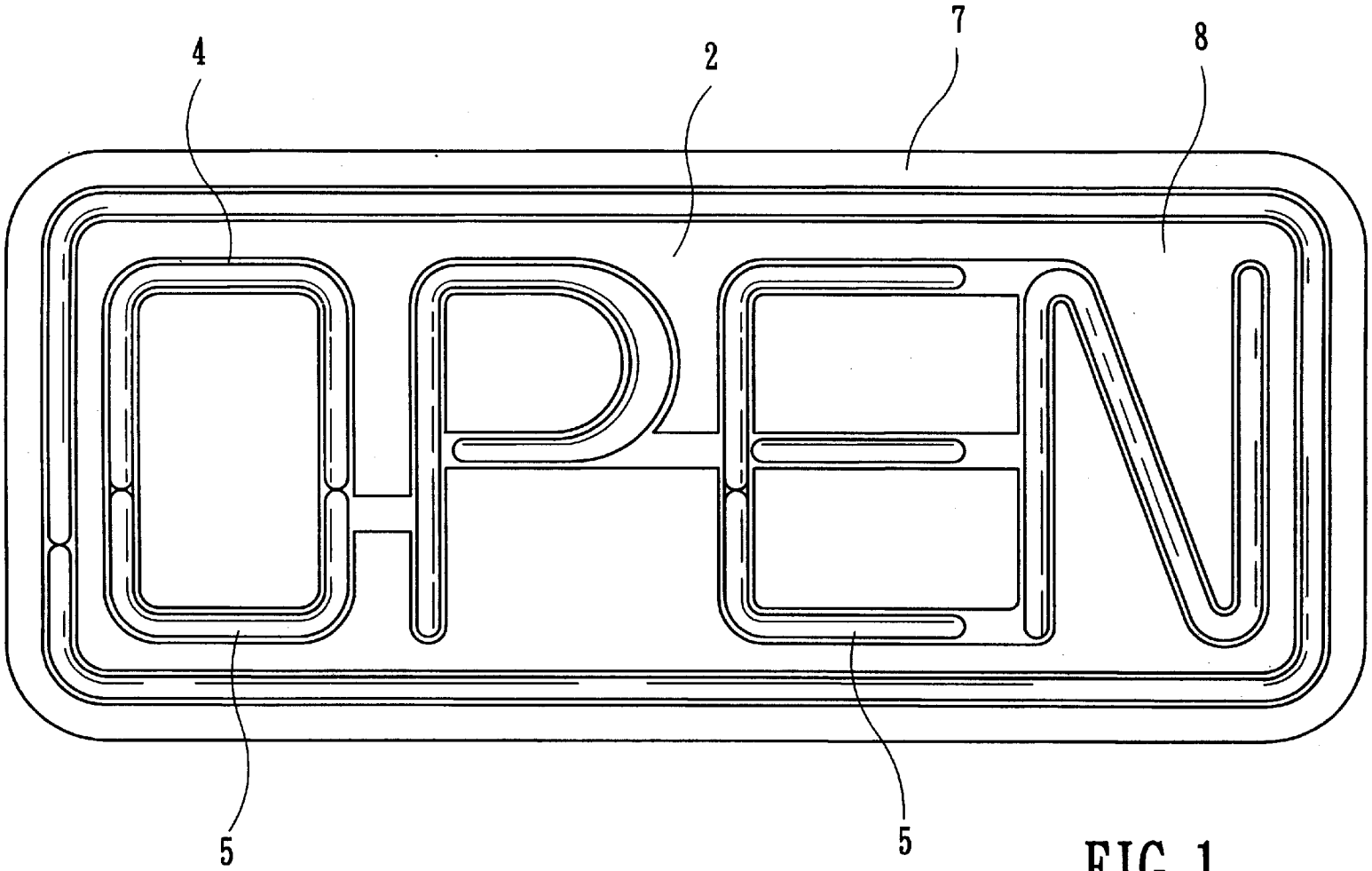
FIG. 1 PRIOR ART
FIG. 1 is a front view of a prior art of indicator light.
Figure 2:
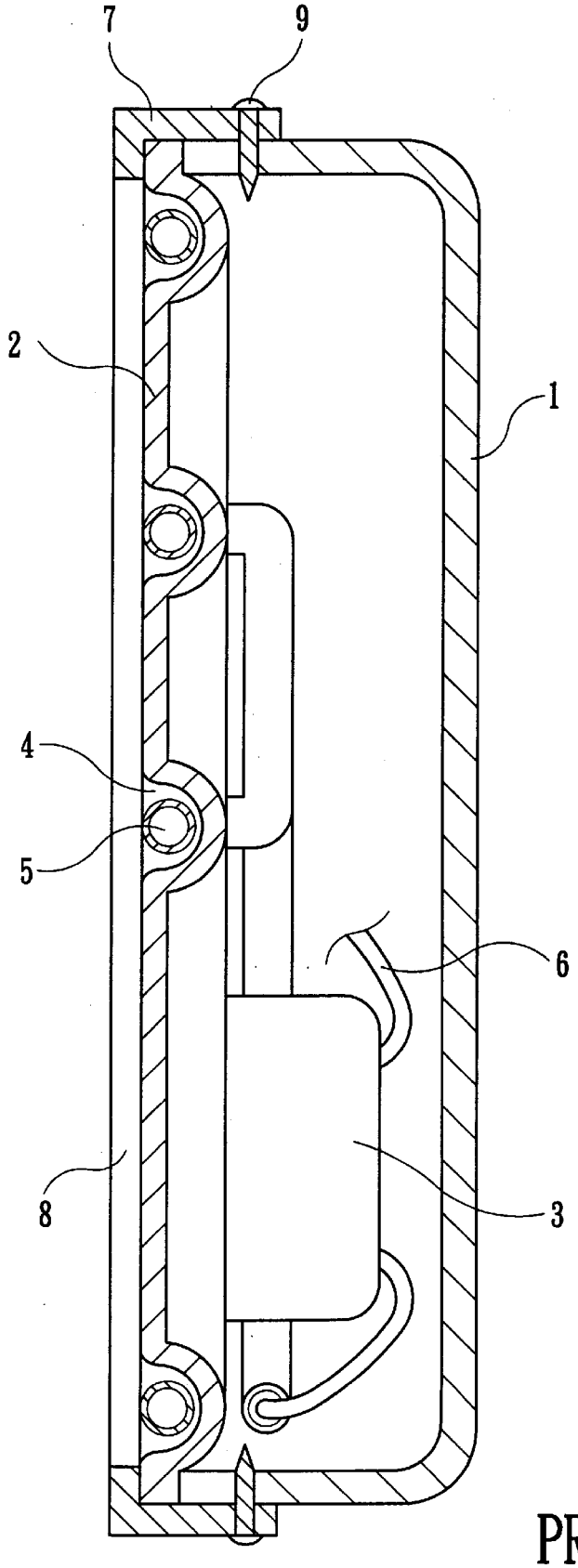
FIG. 2 PRIOR ART
FIG. 2 is a side section view of a prior art of indicator light.
Figure 3:
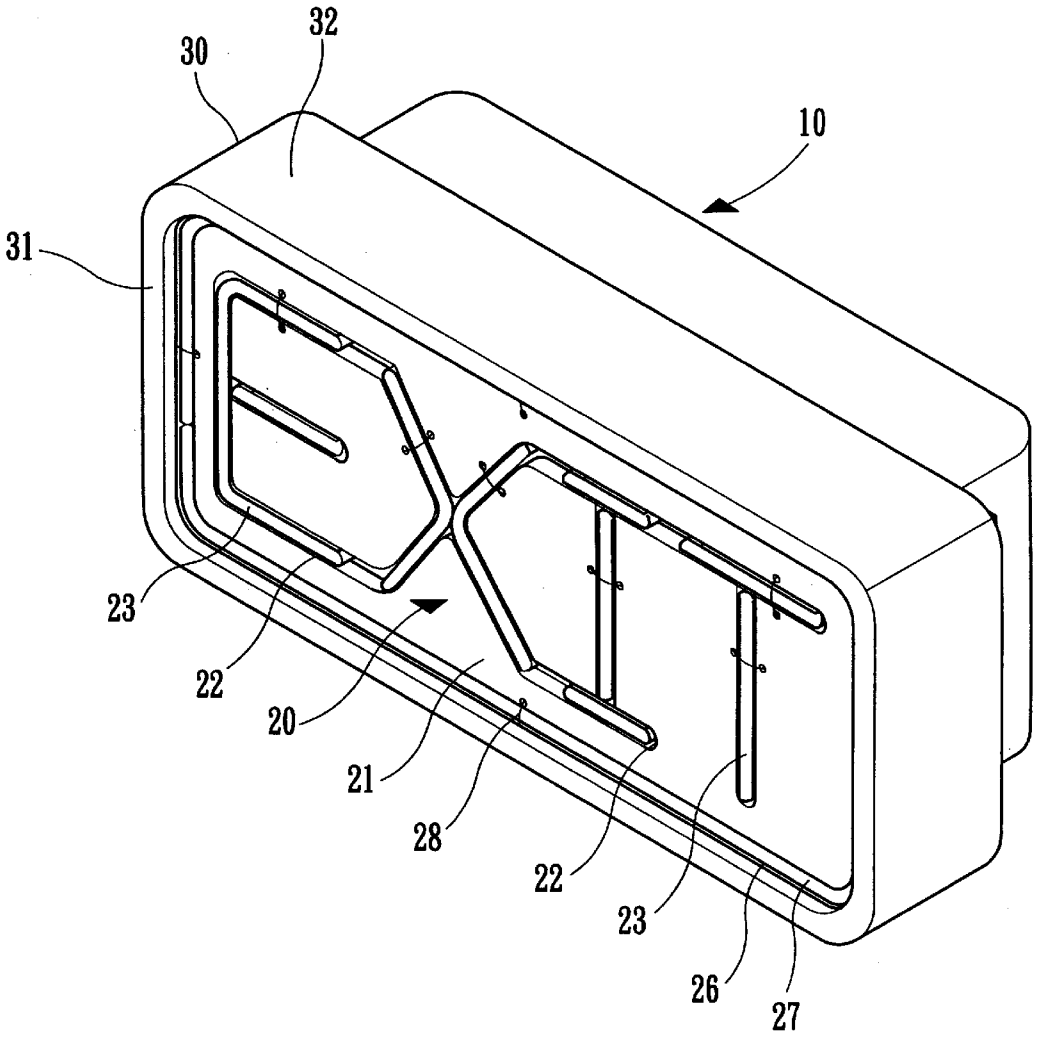
FIG. 3 is a perspective assembled view of the subject matter.
Figure 4:
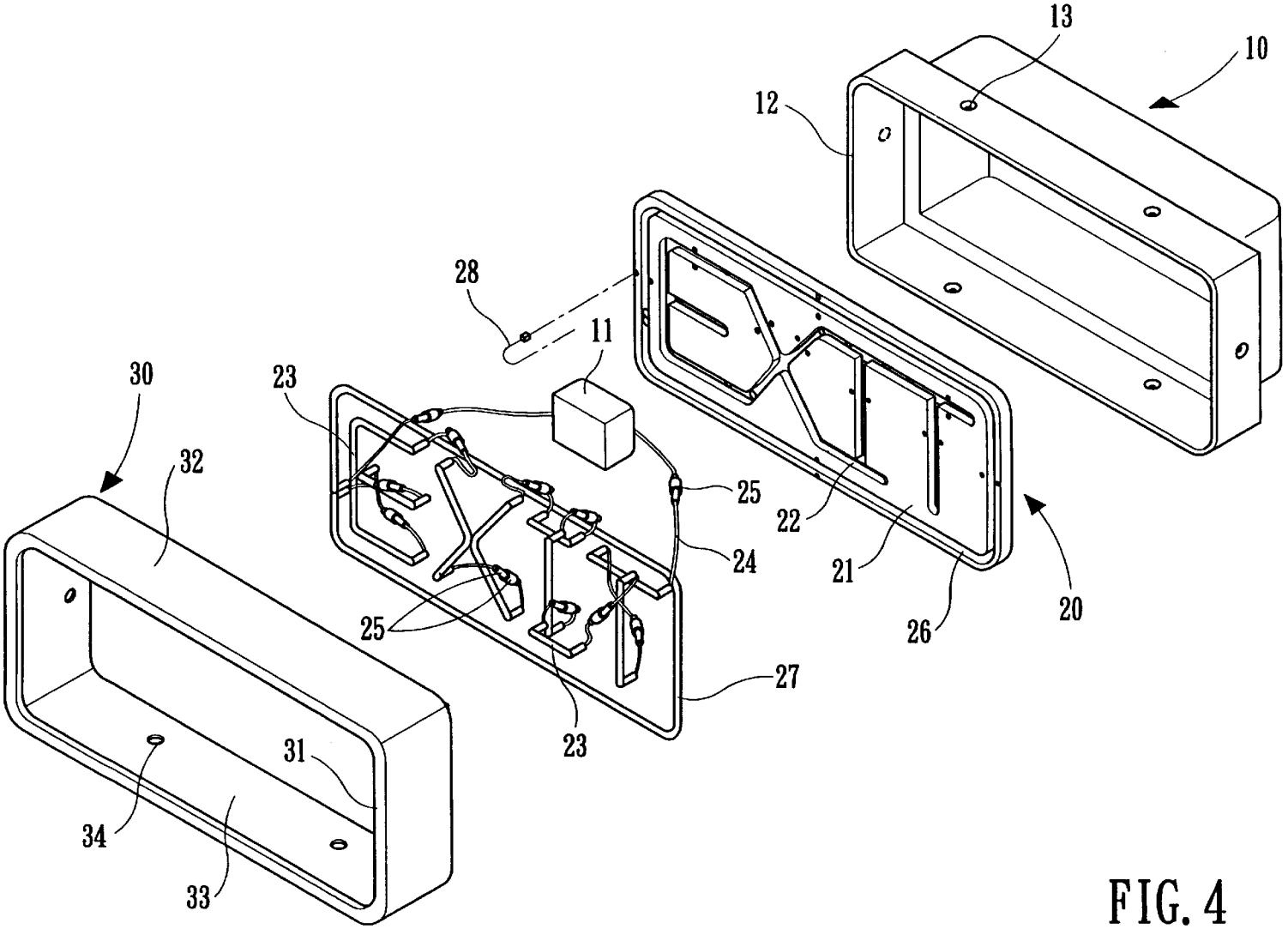
FIG. 4 is an exploded view of the subject matter.
Figure 5:
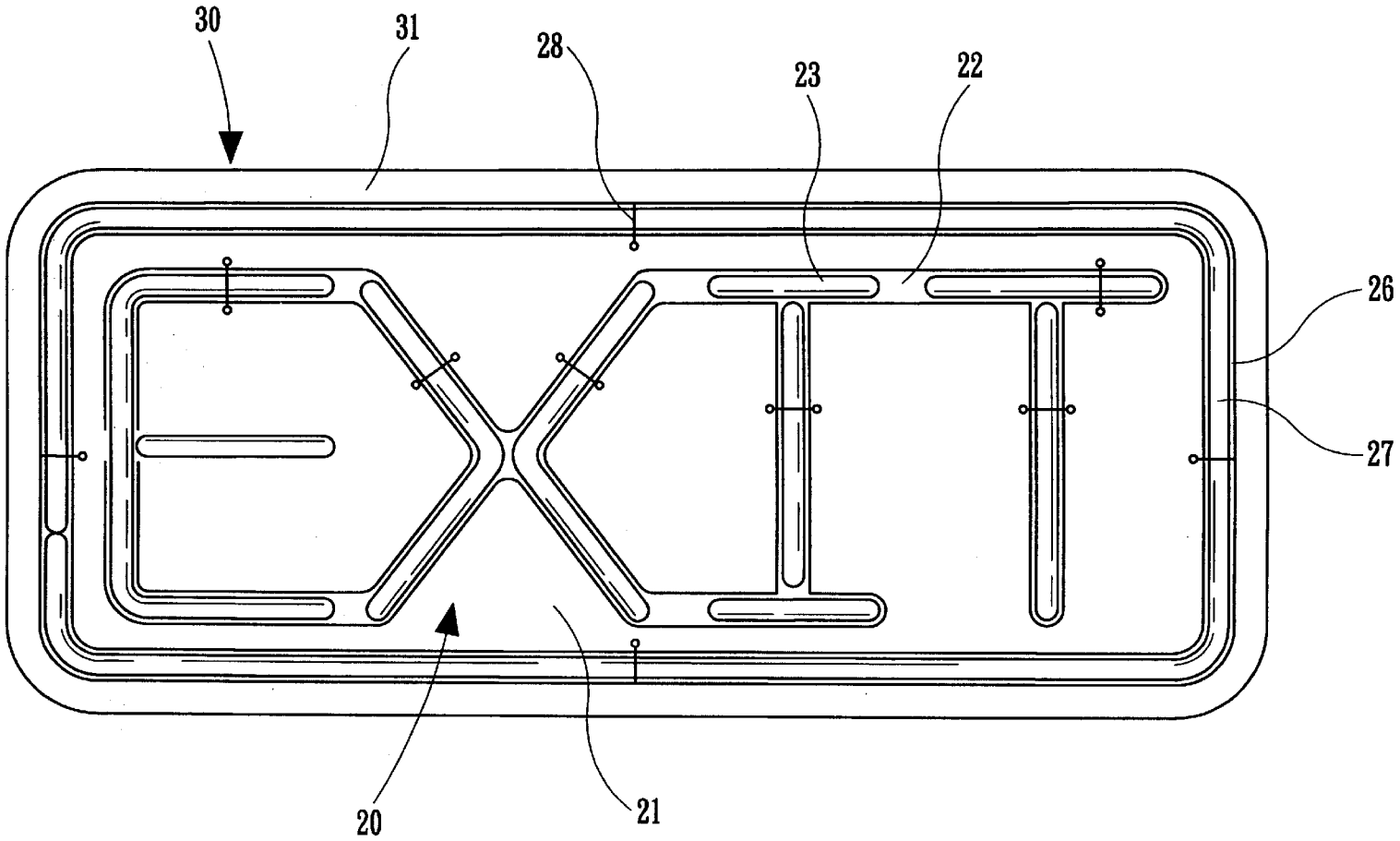
FIG. 5 is a front view of the subject matter.
Figure 6:
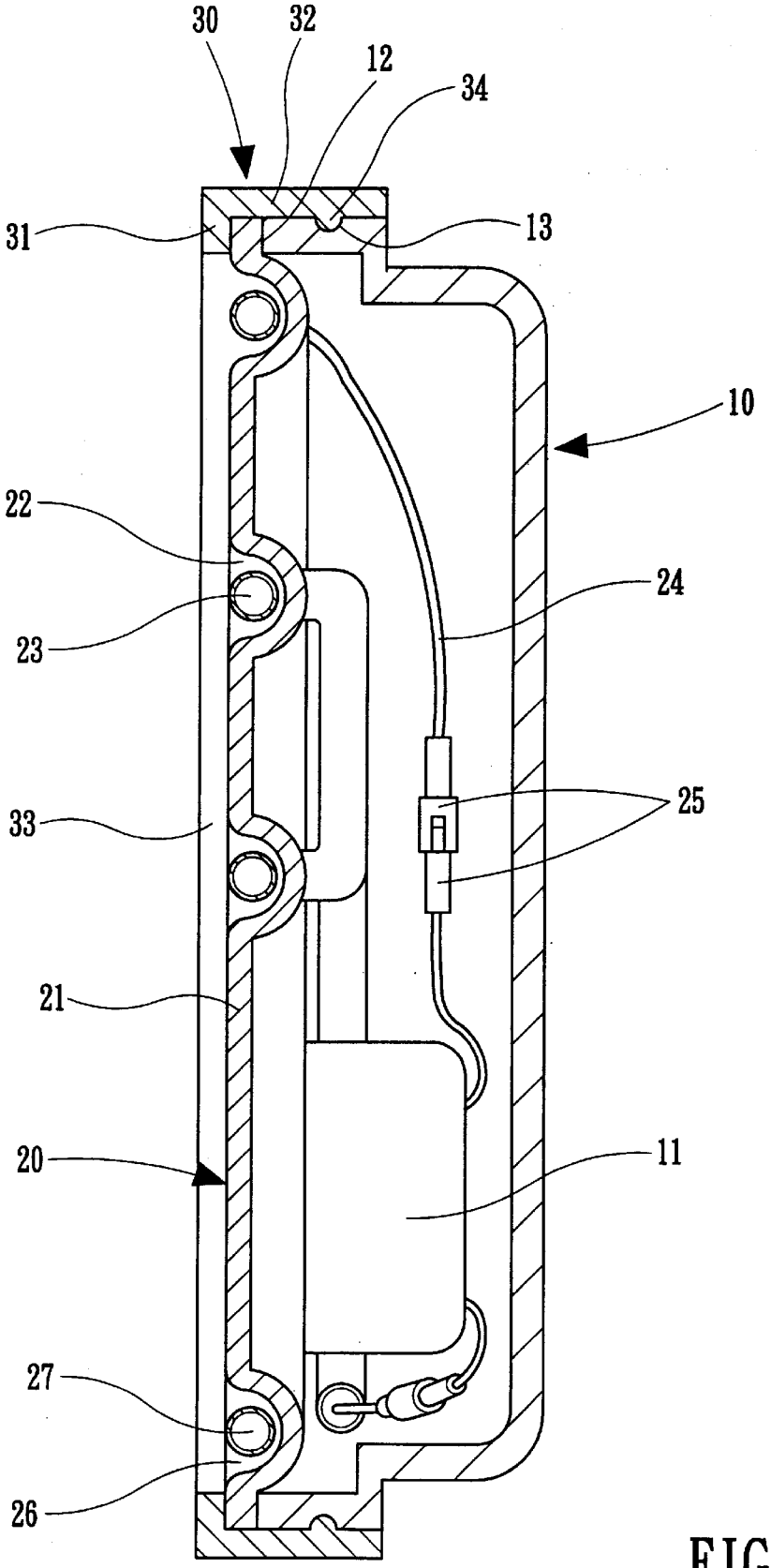
FIG. 6 is a side section view of the subject matter.

As illustrated in FIGS. 3, 4, 5 and 6, the subject matter relates to the presentation of an assembly of lighting indicator, particularly to one that will be able to transmit electrical characters from video signals, comprising a main unit 10, a light plate 20 and an outside frame 30, wherein the main unit 10 is a monoblock-formed non-light-permeable hollow casing with an opening at its front side, the interior of the main unit 10 serves to accommodate a voltage transformer 11 and other electrical circuit components, the front part of the main unit 10 is so shaped to have a carrier 12 to carry the light plate 20, on the outer edge at the front of the main unit 10 are a number of openings 13.

The light plate 20 is a generally plane plate body 21, on said plate body 21 is the formation of properly depressed grooves 22, said grooves 22 serve to make out the outline of two or more characters (such as letters, numerals, etc.), two or more continuous light tubes 23 are inserted inside the grooves 22 for each character and extending along the grooves, said light tubes 23 serve to make out the figured outlines of the grooves, the light tubes 23 are connected by connecting wires 24, between the neighboring connecting wires 24 between the light tubes 23 are two corresponding connectors 25 that may be connected to comprise a circuit, the two connectors 25 may be disengaged from each other, said light plate 20 is carried in the carrier 12 at the front side of the main unit 10, and the light tubes 23 are connected to the transformer 11 inside the main unit 10 by a connecting wire 24, on the connecting wires 24 connecting the light tubes 23 and the transformer 11 are two corresponding connectors 25 that can be coupled, the two connectors 25 may be disengaged as required, the quantity of said connectors 25 depending on the number of the light tubes 23.

Besides, around the edge of the plate body 21 of the light plate 20 is the formation of a depressed groove 26, a frame-shaped light tube 27 is inserted in said groove 26 and extending along the shape of the groove, said light tube 27 makes out the frame outline of the groove 26, said frame-shaped light tube 27 and the transformer 11 and the letter-type light tubes 23 may also be connected by a connecting wire 24 and connectors 25, said frame-shaped light tube 27 is connected with the letter-type light tubes 23 to a same voltage transformer 11, so the frame-shaped light tube 27 and the letter-type light tubes 23 are of a same lighting color, or there may be another transformer (not shown in drawing) to be installed with said frame-shaped light tube 27 in the main unit 10 and connected with a connecting wire and connectors, so as to enable different lighting colors for the frame-shaped light tube 27 and the letter-type light tubes 23, to have a multi-color effect. Said letter-type light tubes 23 and the frame-shaped light tube 27 may also be properly fixed onto the plate body 21 by a fixing piece 28 or other fastening devices.

The shape of the outside frame 30 can be varied, comprising a frame-shaped panel 31 and a side plate 32, on the panel 31 is the formation of a through viewing window 33, on the inside edge of the side plate 32 are a number of protrusions 34, said protrusions 34 corresponding to the openings 13 on the main unit 10. Said outside frame 30 is mounted to the front part of the main unit 10, and by means of the protrusions 34 and the openings 13 on the main unit 10, the outside frame 30 and the main unit 10 can be joined as one unit, while the panel 31 of the outside frame 30 may serve to press and fix the plate body 21 of the light plate 20 into the carrier 12 of the main unit 10; so configured to comprise an indicator lighting device.

Figure 7:
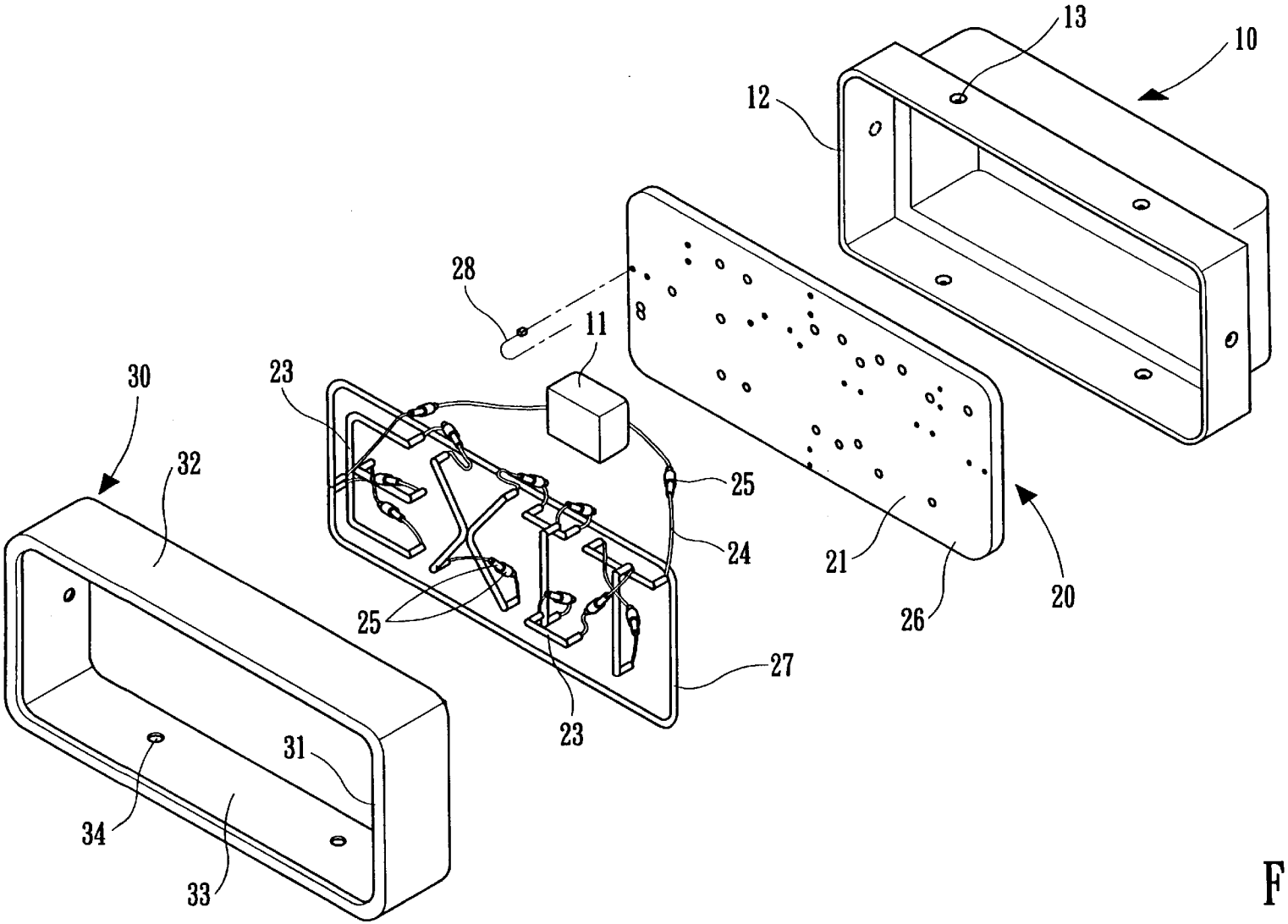
FIG. 7 is an exploded view of another embodiment of the subject matter.

Furthermore, as shown in FIG. 7, an alternative design of the subject matter may have the light tubes 23, 27 fastened to the front side of the plate body 21, so the grooves for the light tubes 23, 27 may be omitted.

To put the subject matter in application, an appropriate power is delivered from the voltage transformer 11, via the connecting wire 24 and the connectors 25 to the light tubes 23, 27, so the light tubes 23, 27 in the grooves 22, 26 of the light plate 20 will light on, and the light coming from the light tubes 23, 27 will be projected to the front side to meet the human eyes.

The subject matter may have the following features:

1. The main unit 10, light plate 20 and the outside frame 30 of the subject matter are all independent units, the main unit 10, the light plate 20 and the outside frame 30 may be separated. For replacement of letter types or figure patterns on the light plate 20, all the user need to do is remove the light plate 20, without replacing the outside frame 30, so it has the feature of reduced costs.
2. The main unit 10, the light plate 20 and the outside frame 30 of the subject matter are joined to become one unit by means of dowels, therefore, they are easily disassembled without using any tools.
3. Between the light tubes 23 themselves and between the light tubes 23 and the transformer 11 are the connections by means of connecting wires 24 and connectors 25, so the light tubes 23 require no welding process to weld them together, therefore, there is no need of light-obstructing treatment on the non-letter-type portion of the light tubes 23, the result is reduced consumption of power energy. In case any one light tube 23 is defective, the user need only disengage and separate the connector 25, in order to replace the defective light tube 23, so there is no need to replace the entire light tube unit, and the result is reduced costs.

Summing up, the subject matter, with its improvement on the shortcomings of conventional indicator lighting devices such as inability to replace only the light plate, inconvenience in disassembling the main unit and the light plate, higher power consumption due to welded connection of the light tubes, inability to replace only the light tubes, increased costs etc., is indeed a novel creation with its novelty and originality that will fully satisfy the qualifications for a patent right, hence this application is filed in accordance with the Patent Law to protect the subject inventor's rights and interests.

It is declared hereby that the above description, covering only the preferred embodiment of the subject matter, should not be based to limit or restrict the subject claim, and that all equivalent structural and/or configurational variations and/or modifications easily conceivable to anyone skilled in the subject art, and deriving from the subject description with drawings herein shall reasonably be included in the intent of the subject claim.

I claim:

1. A lighting indicator assembly, comprising:

a main unit, said main unit including a hollow casing accommodating a voltage transformer therein, said main unit having a carrier part formed on a front side thereof, said carrier part having a plurality of openings formed therein;

a light plate disposed in said carrier part, said light plate including (a) a plate body, (b) a plurality of individual light tubes disposed in a predetermined configuration representing a plurality of alphanumeric characters, each of said alphanumeric characters being defined by at least a respective two of said plurality of individual light tubes, (c) a plurality of connecting wires respectively connected to said individual light tubes, and (d) a plurality of connectors respectively coupled to said connecting wires for respectively interconnecting said individual light tubes and connecting said individual light tubes to said transformer; and an outside frame for receiving said carrier part therein, said outside frame being formed by a frame-shaped panel and a side plate, said frame-shaped panel circumscribing a viewing window opening, said side plate having a plurality of protrusions extending therefrom for respective engagement with said plurality of openings of said carrier part, said frame-shaped panel on the outside frame pressing and securing said plate body of the light plate into the carrier of the main unit.

2. A lighting indicator assembly, comprising:

a main unit, said main unit including a hollow casing accommodating a voltage transformer therein, said main unit having a carrier part formed on a front side thereof, said carrier part having a plurality of openings formed therein;

a light plate disposed in said carrier part, said light plate including (a) a plate body, said plate body having a plurality of grooves defining an outline of at least two alphanumeric characters, (b) at least two continuous light tubes for each of said alphanumeric characters respectively disposed in said plurality of grooves to form illuminated representations of said alphanumeric characters, (c) a plurality of connecting wires respectively connected to said light tubes, and (d) a plurality of connectors respectively coupled to said connecting wires for respectively interconnecting said light tubes and connecting said light tubes to said transformer; and an outside frame for receiving said carrier part therein, said outside frame being formed by a frame-shaped panel and a side plate, said frame-shaped panel circumscribing a viewing window opening, said side plate having a plurality of protrusions extending therefrom for respective engagement with said plurality of openings of said carrier part, said frame-shaped panel on the outside frame pressing and securing said plate body of the light plate into the carrier of the main unit.

* * * * *